US009198517B2

(12) United States Patent
Qiao

(10) Patent No.: US 9,198,517 B2
(45) Date of Patent: Dec. 1, 2015

(54) ADJUSTABLE WORKING PLATFORM ON SITTING FURNITURE

(71) Applicant: Heyang "Jeremy" Qiao, Blacksburg, VA (US)

(72) Inventor: Heyang "Jeremy" Qiao, Blacksburg, VA (US)

( * ) Notice: Subject to any disclaimer, the term of this patent is extended or adjusted under 35 U.S.C. 154(b) by 0 days.

(21) Appl. No.: 14/617,421

(22) Filed: Feb. 9, 2015

(65) Prior Publication Data

US 2015/0265059 A1 Sep. 24, 2015

Related U.S. Application Data

(60) Provisional application No. 61/969,208, filed on Mar. 23, 2014, provisional application No. 62/018,341, filed on Jun. 27, 2014.

(51) Int. Cl.

| | |
|---|---|
| ***A47B 83/02*** | (2006.01) |
| ***A47C 7/68*** | (2006.01) |
| ***A47B 13/08*** | (2006.01) |

(52) U.S. Cl.

CPC ..... *A47C 7/68* (2013.01); *A47B 13/081* (2013.01)

(58) Field of Classification Search

CPC ..... A47B 23/002; A47B 23/02; A47C 7/68; A47C 7/70; A47D 1/002; A47D 1/006; A47D 1/008

USPC ..... 108/49, 42, 43; 297/145, 149, 148, 297/184.12, 153, 161

See application file for complete search history.

(56) References Cited

U.S. PATENT DOCUMENTS

| | | | | | |
|---|---|---|---|---|---|
| 1,068,593 | A | * | 7/1913 | Koch | 297/149 |
| 1,478,780 | A | * | 12/1923 | Akesson | 297/149 |
| 1,693,166 | A | * | 11/1928 | Walcom | 297/251 |
| 1,694,146 | A | | 12/1928 | H et al. | |
| 1,983,138 | A | * | 12/1934 | Lehman | 297/149 |
| 2,022,955 | A | * | 12/1935 | Davis | 297/153 |
| 2,024,667 | A | * | 12/1935 | Stinson | 297/149 |
| 2,724,429 | A | * | 11/1955 | Warner | 297/149 |
| 3,206,249 | A | * | 9/1965 | Gateley | 297/411.23 |
| 3,276,045 | A | * | 10/1966 | Bement | 108/49 |
| 3,511,531 | A | * | 5/1970 | Benoit et al. | 297/153 |
| 4,512,607 | A | * | 4/1985 | Rapp | 297/153 |
| 5,598,786 | A | * | 2/1997 | Patterson | 108/43 |
| 5,612,718 | A | | 3/1997 | Bryan | |
| 5,758,889 | A | * | 6/1998 | Ledakis | 297/184.13 |
| 5,816,649 | A | | 10/1998 | Shields | |
| 6,044,758 | A | | 4/2000 | Drake | |

(Continued)

*Primary Examiner* — Jose V Chen

(74) *Attorney, Agent, or Firm* — New River Valley IP Law, P.C.; Michele L. Mayberry

(57) ABSTRACT

The adjustable workstation platform described herein provides four-way adjustable support for a raised platform to hold objects like a laptop, a tablet or a book for a user. The adjustable workstation platform comprises a first support member, a second support member, and a raised platform for supporting an object. The raised platform comprises a first end, a second end, and a planar middle section disposed between the first and second ends wherein a portion of each of the first and second ends has a degree of curvature enabling the first and second ends to curve and extend in a downward direction from the middle section at a point where each of the first and second ends communicate with the middle section. The first and second support members are configured for receiving the first or second ends of the raised platform. Further described herein are articles of furniture comprising the adjustable platform and kits comprising the elements of the adjustable platform for assembly.

20 Claims, 15 Drawing Sheets

(56) References Cited

U.S. PATENT DOCUMENTS

| | | | | |
|---|---|---|---|---|
| 6,045,179 | A * | 4/2000 | Harrison | 297/188.2 |
| 6,116,165 | A * | 9/2000 | Kadesky | 108/43 |
| 6,173,725 | B1 * | 1/2001 | Garth | 297/184.1 |
| 6,354,658 | B1 | 3/2002 | Sher et al. | |
| 6,773,060 | B2 | 8/2004 | Sher et al. | |
| 7,059,253 | B2 * | 6/2006 | Cho | 108/90 |
| 7,293,751 | B2 | 11/2007 | Eriksson | |
| 7,862,111 | B2 | 1/2011 | Steenson | |
| 7,931,339 | B1 | 4/2011 | Stocker et al. | |
| 8,079,553 | B1 | 12/2011 | Martin | |
| 8,667,903 | B1 | 3/2014 | Goltry | |
| 2007/0029848 | A1 * | 2/2007 | Probst | 297/148 |
| 2007/0151489 | A1 | 7/2007 | Byrne | |
| 2009/0254011 | A1 * | 10/2009 | Chi | 297/148 |
| 2011/0017105 | A1 | 1/2011 | Valdivia | |

* cited by examiner

ADJUSTABLE WORKING PLATFORM ON SITTING FURNITURE

CROSS-REFERENCE TO RELATED APPLICATIONS

This application claims priority to and the benefit of the filing dates of U.S. Provisional Application No. 61/969,208, filed Mar. 23, 2014 and U.S. Provisional Application No. 62/018,341, filed Jun. 27, 2014, the disclosures of which are hereby incorporated by reference herein in their entirety.

FIELD OF THE INVENTION

This disclosure relates generally to the field of furniture and furniture accessories. More particularly, the instant disclosure relates to an adjustable platform for application to the surface of an article of furniture (e.g., a chair, couch, sofa, bed, futon, etc.) to allow a user to comfortably use a personal item, such as a laptop, e-reader, or magazine, while using the furniture. The disclosure further relates to articles of furniture comprising the adjustable platform described herein.

BACKGROUND OF THE INVENTION

In the furniture industry, residential and office furniture is often separated into two distinct markets. Typically, residential furniture is designed and marketed towards comfort and aesthetics while office furniture is designed and marketed to enhance business productivity and comfort while working at a computer station or desk. More and more, however, people are working from home and current furniture options fail to reconcile these two distinct furniture markets to account for the needs of the professional working at home.

Moreover, the widespread use of personal electronic devices has more people connected to a host of devices more often, for longer periods of time, and for a variety of purposes. No longer are personal electronic devices used exclusively for business or educational purposes. Personal electronic devices have become integrated into every part of a person's life and are used for personal pleasure as well—from reading books (e.g., e-readers), to interacting with others on social media networks, to playing video games, as well as watching movies and television programming online. Consequently, personal electronic devices are often used many hours a day by the user, including those times when the user is relaxing in the comfort of their own home.

To enhance a user's comfort, tables and platforms have been devised to assist the user when using a personal item while sitting in furniture. Current solutions, including existing adjustable platforms for use with furniture, are provided in U.S. Pat. Nos. 7,293,751; 7,862,111; 6,773,060 and 8,079,553 as well as U.S. Patent Application Publication No.: 2011/0017105, and each have myriad shortcomings.

For example, some of the existing devices are designed for adjustment to either the dimensions of the furniture or the user, not adjustable to fit both the furniture and the user. What's more, in considering the existing devices which are adjustable, those devices tend to require complicated adjustment systems having unnecessary moving parts and pieces, which tends to complicate the device, makes it less reliable, harder to produce without any accompanying benefit, and less attractive when used in the home with existing furniture. With some devices, the user may have to affix the device to an article of furniture with unsightly straps and/or bolt-and-screw like attachment systems. Accordingly, a need exists for an adjustable platform for application to an article of furniture that is adjustable in multiple directions to accommodate the dimensions of the user and the furniture, durable, easily installable, and stylish.

SUMMARY OF THE INVENTION

The current disclosure describes an adjustable workstation platform (i.e., an adjustable platform). The adjustable platform allows the user to be able to work with a device (e.g., a personal electronic device, a book, etc.) while remaining comfortable in an article of furniture such as a sofa or lounge chair.

The described solution mounts a small table (i.e., platform) on support members (e.g., armrests) for application to furniture, such as sofas or lounge chairs. The platform is designed to hold objects like laptops, tablets and books. It also has a space for a mouse and mouse pad to better control a device such as a laptop computer. Furthermore, the adjustable platform includes a small platform with a proper reclining angle and may include a high friction material covering (e.g., a rubber coated surface) the top of the platform to create a steady support (e.g., a "no-slip" surface) for laptops while simultaneously accommodating the ergonomics of both of the user's arms.

The adjustable platform may also include a track on at least one side of the support members to allow distance adjustment between the platform and the user and two support members. Both distances, between the platform and the user, and between the two armrests, are adjustable to accommodate a large variety of body sizes.

The adjustable platform also takes another utility into consideration. The whole system can be mounted to existing furniture regardless of whether armrests are present or absent on the existing furniture. This versatility permits a broad application of the adjustable platform to a number of furniture classes (e.g., chairs, beds, futons, couches, sofas, etc.).

It is an object of the embodiments described herein that the adjustable working platform (i.e., the adjustable platform) is for use on some sitting surface, such as an article of sitting furniture (e.g. a chair or couch). The adjustable platform can be a set of different pieces, including a platform and two armrests, and has a number of useful purposes.

The adjustable platform can be adjusted in four direction and the armrests can provide a flat surface for one or more personal electronic device accessories (e.g., a mouse, a mouse pad, etc.).

Further, the adjustable platform is useful as a holding platform for a personal electronic device (e.g., a laptop computer or a tablet), book, or magazine while the object is being used or while other tasks are being performed.

In embodiments provided throughout the disclosure, the adjustable platform, as described herein, may have at least one moveable armrest and a slide track (i.e., a track). The adjustable platform may also comprise armrest covers if the furniture for which the platform will be used has existing armrests.

It is an object of embodiments disclosed herein to provide an adjustable platform for application to a sitting surface. The adjustable workstation platforms described herein comprise a first support member, a second support member, and a raised platform for supporting an object. As provided throughout the disclosure, the raised platform comprises a first end, a second end, and a planar middle section disposed between the first and second ends wherein a portion of each of the first and second ends has a degree of curvature enabling the first and second ends to curve and extend in a downward direction from the middle section at a point where each of the first and second ends communicate with the middle section. The first and second support members are configured for receiving the first or second ends of the raised platform. As will become apparent, the first and second support members may be armrests or armrest covers.

To provide an ergonomically acceptable configuration for the user, the middle section of the adjustable platform may slope in a downward direction from a distal edge of the middle section to a proximal edge of the middle section. As will be described, the middle section may slope in a downward direction from a distal edge of the middle section to a proximal edge of the middle section at angle between about 90 degrees and about 0 degrees, but in particular aspects, at an angle between 45 degrees and 5 degrees.

Considering additional aspects of comfort for the user, at least one of the first and second support members is independently and selectively movable. In certain aspects, only one of the first and second support members will be independently and selectively movable. Further still, in certain other embodiments, at least one of the first and second support members further comprise a track member for receiving an end (e.g., the first or second end) of the platform. As will be described herein, in particular aspects, both the first and second support members comprise a track member for receiving the first and second ends of the platform, while in others, only one of the support members comprise a track member for receiving an end of the platform. Additional embodiments provide for at least one of the support members further comprising at least one auxiliary accessory, such as a cup holder or an electronic accessory, such as a mouse pad, for added user function.

In certain particular embodiments the first end of the platform may extend in a downward direction from the middle section farther than the second end of the platform, such that the first end has a height greater than the second end. As will be provided in more detail, in these embodiments, the first support member may comprise a track member positioned to receive the overly-extended first end of the platform with the second support member properly configured to receive the second end of the platform. Further still, in these embodiments, only the first support member is independently and selectively movable.

Still further provided is an article of furniture comprising a platform described herein. The articles of furniture can be any piece of furniture—chairs, sofas, futons, etc.

Also provided is a ready to assemble adjustable platform kit. The kit comprises a first package comprising a pair of support members and a second package comprising a raised platform comprising a first end, a second end, and a planar middle section disposed between the first and second ends. When assembled, the first and second support members are configured for receiving opposing ends of the raised platform.

Additional features and advantages will be set forth in the detailed description which follows, and in part will be apparent from the description, or may be learned by the implementation of the principles of the embodiments disclosed and described below. The features and advantages may be realized and obtained by means of the instruments and combinations particularly pointed out in the appended claims.

BRIEF DESCRIPTION OF THE DRAWINGS

In order to describe the manner in which the above-recited and other advantages and features of the disclosed embodiments can be obtained, a more particular description will be provided by reference to specific embodiments which are illustrated in the appended drawings. The drawings depict only exemplary embodiments and are not, therefore, to be considered to be limiting of its scope. The embodiments will be described and explained with additional specificity and detail through the use of the accompanying drawings in which.

DETAILED DESCRIPTION OF VARIOUS EMBODIMENTS OF THE INVENTION

Figure 1:
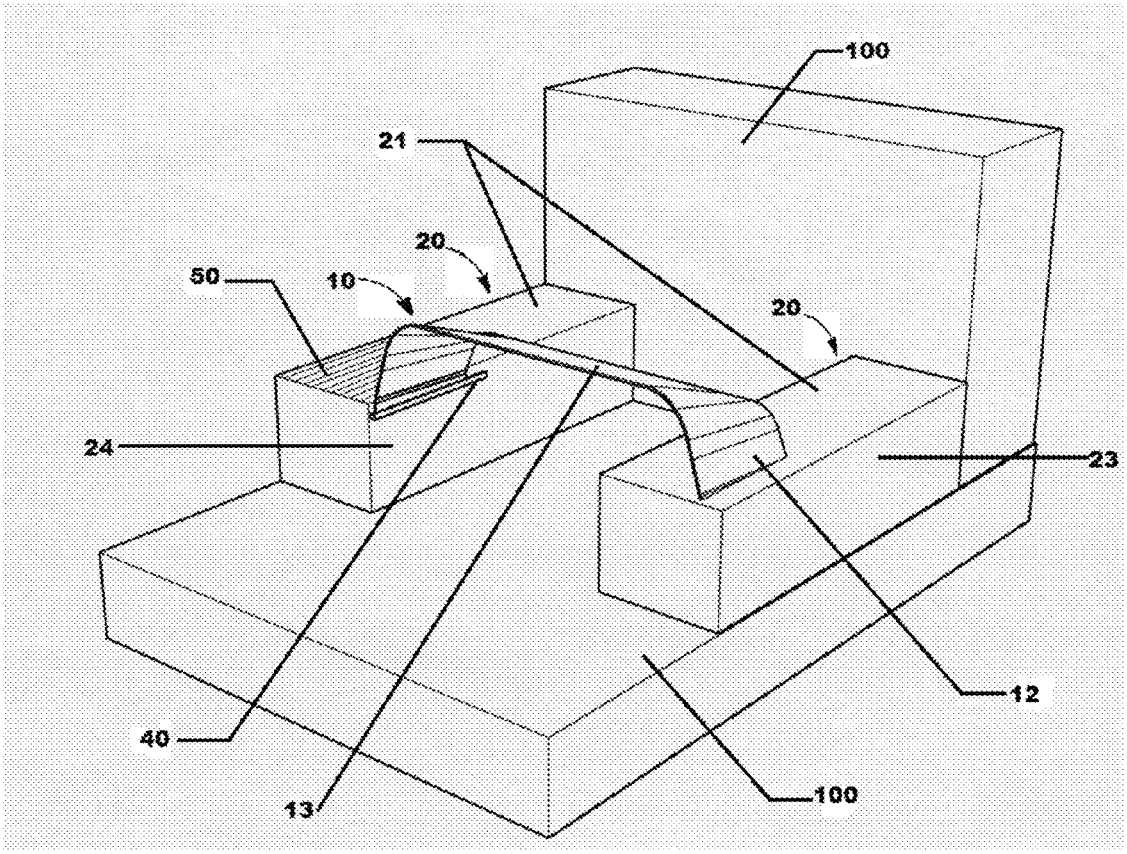
FIG. 1 is a schematic diagram showing a perspective view of an embodiment of the adjustable platform as described herein.

The following description supplies specific details in order to provide a thorough understanding of various embodiments described herein. Nevertheless, the skilled artisan would understand that embodiments of the adjustable platform and associated methods of making and using them can be implemented and used without employing these specific details. Indeed, exemplary embodiments and associated methods can be placed into practice by modifying the illustrated units and associated methods and can be used in conjunction with any other devices and techniques conventionally used in the industry.

Adjustable Platform

Embodiments of the adjustable workstation platform 1 as described herein and with reference to the appended figures, comprise a platform 10, a pair of support members (e.g. armrests 20 or armrest covers 30), and optionally a track member 40 for receiving the platform.

The adjustable working platform 1 as described throughout comprises first and second support members 20; and a raised platform 10 for supporting an object. The raised platform 10 comprises a first end 11, a second end 12, and a planar middle section 13 disposed between the first and second ends 11, 12;

wherein a portion of each of the first and second ends 11, 12 has a degree of curvature enabling the first and second ends 11, 12 to curve and extend in a downward direction from the middle section at a point where the first and second ends 11, 12 communicate with the middle section 13; and wherein the first and second support members 20 are configured for receiving the first or second ends 11, 12 of the raised platform 10.

Further disclosed herein are articles of furniture 200 comprising the adjustable platform 1 described herein.

Elements of the adjustable platform 1 will be described in detail and with reference to the appended figures.

Platform

The platform 10, as described throughout, is configured for communication with the support members described herein when the platform is being used by a user.

The platform 10, as described throughout, may be made of any acceptable material so long as the chosen material is of sufficient strength and rigidness to withstand the rigors of its intended use. As described herein, the platform 10 may be any conceivable shape (e.g., circular, parabolic, U-shaped, trapezoidal, polygonal, such as a triangular, square, pentagonal, hexagonal, or octagonal in shape etc.) so long as the platform 10 can support at least one object and is of sufficient length, width, and height that the platform 10 can be in communication with the support members 20 when being used by a user while still supporting at least one object.

Non-limiting examples of acceptable materials for manufacture of the platform 10 include metals, alloys, plastics, polymers, woods, combinations of materials comprising metals, alloys, plastics, and/or woods, composite materials, etc.

In particular embodiments, the platform 10 is manufactured from at least one plastic material. Non-limiting examples of plastics acceptable for the manufacture of the platform 10 include polyolefins, polyesters, nylons, polynylons, vinyls, polyvinyls, acrylics, polyacrylics, polycarbonates, polystyrenes, polyurethanes, as well as combinations thereof, and the like.

In a more particular embodiment, the platform 10 is manufactured from at least one metallic material. Non-limiting examples of metallic materials acceptable for the manufacture of the platform 10 include aluminum, steel, nickel copper, magnesium, titanium, iron, brass, as well as alloys and combinations thereof and the like.

It is expected that the chosen material and shape of the platform 10 will adequately support one or more objects placed on the platform 10. Non-limiting examples of objects intended to be supported by the platform 10, include personal electronic devices (e.g., laptop computers, tablets, such as an iPad® by Apple Corporation, smartphones, e-readers, such as a Kindle® by Amazon, etc.) books, magazines, newspapers, playing cards, etc.

As described throughout, the platform 10 comprises a first end 11, a second end 12, and a middle section 13 disposed therebetween. The platform 10 is a raised platform and comprises a distal edge and a proximal edge. As used herein, the term "distal edge" is defined as the edge farthest in proximity from a user when he or she is using the adjustable platform described herein for its intended purpose. Further, as used herein, the term "proximal edge" is defined as the edge parallel to the distal edge. The term "side edge(s)" is defined as an edge(s) that not a proximal or distal edge. In some embodiments, the side edge may be an edge(s) that is perpendicular to a proximal and/or distal edge.

In particular, the middle section 13 is planar, or substantially planar, and comprises at least four edges. In particular embodiments, the middle section 13 has at least a distal edge, a proximal edge, and two side edges.

As used herein, the term "planar" means flat or lying in a single geometric plane. As used herein, the term "substantially" means the complete, or nearly complete, extent or degree of an action, characteristic, property, state, structure, item, or result. As an arbitrary example, an object that is "substantially planar" means that the object is either completely planar or nearly completely planar. The exact allowable degree of deviation from absolute completeness may in some cases depend on the specific context.

For the purposes of clarity, the metes and bounds of the middle section 13 are defined by a planar geometry. The first and second ends 11, 12, communicate with the middle section 13 where the middle section terminates (i.e., where the middle section is no longer planar in geometry).

As described herein, the first and second ends 11, 12, are in communication with, or in some aspects affixed to, the middle section 13. More particularly, the first and second ends 11, 12 are in communication with, or in some aspects affixed to, opposing edges of the middle section 13. In still a more particular embodiment, the first and second ends 11, 12 are in communication with, or in some aspects affixed to, opposing side edges of the middle section 13.

In certain embodiments the first and second ends 11, 12 can be permanently fixed or reversibly coupled to the middle section 10 or formed in a one-piece formation.

In a particular aspect, the first and second ends 11, 12 of the platform 10 can be separate pieces which are attached to the middle section 13. In a more particular aspect, the first and second ends 11, 12 are triangular shaped ends attached to the middle section 13. Methods for attaching multiple materials are known in the art. Non-limiting examples include welding, screwing, riveting, adhesives, etc.

In a particular embodiment, the first and second ends 11, 12 are permanently affixed to the middle section 13 using hinges. Attachment via hinge coupling may provide compact folding and storage of the platform 10 when it is not being used by the user. In still other embodiments, the first and second ends 11, 12, are reversibly coupled to the middle section 13. Attachment systems which permit reversible coupling include hook-and-loop systems, tab-slot systems, etc.

In another particular embodiment, the first end 11, the second end, 12, and the middle section 13 of the platform 10 are formed in a one-piece formation. Methods for manufacturing in one-piece formation are known in the art. Non-limiting examples of methods for one-piece formation manufacturing include stamping, hydroforming, mold manufacturing (e.g. injection molding, compression molding, cast molding, thermoform molding, etc.), 3-D printing, etc. In particular embodiments, the platform 10 is a single, continuous piece of material from first end 11 through the middle section 13 through second end 12, and ideally with no seams between first end 11 and middle section 13 or between second end 12 and middle section 13, and/or ideally with no attachment mechanism joining first end 11 or second end 12 to middle section 13. In a more particular aspect, the proximal edge of the platform and the distal edge of the platform are the same length. In another aspect, the proximal edge of the platform and the distal edge of the platform are different lengths. In a particular aspect, the proximal edge is shorter than the distal edge. In still another particular aspect, the proximal edge is longer than the distal edge.

In particular aspects, the platform 10 is a raised platform. In still a more particular aspect, the platform is a raised platform and comprises a first end 11, a second end 12, and a planar middle section disposed between the first and second ends 11, 12, wherein a portion of each of the first and second ends has a degree of curvature enabling the first and second ends to curve and extend in a downward direction from the middle section at a point where each of the first and second ends communicate with (e.g., intersect with) the middle section 13. In yet a more particular aspect, the platform 10 is a raised platform and comprises a planar middle section 13 wherein the first end 11 of the platform 10 and the second end 12 of the platform 10 curve from the middle section 13 in a downward direction such that the middle section 13 slopes downwardly (i.e., in a declined posture) from the distal edge of the middle section toward the proximal edge of the middle section. In embodiments, the slope of the middle section may depend upon the degree of curvature of the first and second ends 11, 12 respectively. In particular embodiments, the middle section 13 slopes downward from the distal edge of the middle section 13 to the proximal edge of the middle section 13 at an angle between about 90 degrees and about 0 degrees (e.g., 90 degrees, 89 degrees, 88 degrees, 87 degrees, 86 degrees, 85 degrees, 84 degrees, 83 degrees, 82 degrees, 81 degrees, 80 degrees, 75 degrees, 70 degrees, 65 degrees, 60 degrees, 55 degrees, 50 degrees, 45 degrees, 40 degrees, 35 degrees, 30 degrees, 25 degrees, 20 degrees, 15 degrees, 10 degrees, 9 degrees, 8 degrees, 7 degrees, 6 degrees, 5 degrees, 4 degrees, 3 degrees, 2 degrees, 1 degrees, up to about 0 degrees). In a more particular aspect, the middle section 13 forms an angle between about 45 degrees and about 5 degrees.

Unless specifically stated or obvious from context, as used herein, the term "about" is understood as within a range of normal tolerance in the art, for example within 2 standard deviations of the mean. The term "about" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

In particular aspects, the degree of curvature of first and second ends 11, 12 is greatest at the point where the first and second ends 11, 12 substantially intersect with the distal edge of the middle section 13 and is least at the point where the first and second ends 11, 12 substantially intersect with the proximal edge of the middle section 13. In a more particular aspect, the degree of curvature of first and second ends 11, 12 is greatest at the point where the first and second ends 11, 12 substantially intersect with the distal edge of the middle section 13 with the degree of curvature continuously and gradually decreasing until the first and second ends 11, 12 substantially intersect with the proximal edge of the middle section 13. In still a more particular aspect, the degree of curvature of the first and second ends 11, 12 ranges from about 90 degrees to about 0 degrees. In yet a more particular aspect, the degree of curvature of the first and second ends 11, 12 ranges from about 90 degrees at the point where the first and second ends 11, 12 substantially intersect with the distal edge of the middle section 13 with the degree of curvature continuously and gradually decreasing to about 0 degrees where the first and second ends 11, 12 substantially intersect with the proximal edge of the middle section 13. In still yet a more particular aspect, the degree of curvature of the first and second ends 11, 12 ranges from about 60 degrees at the point where the first and second ends 11, 12 substantially intersect with the distal edge of the middle section 13 with the degree of curvature continuously and gradually decreasing to about 0 degrees where the first and second ends 11, 12 substantially intersect with the proximal edge of the middle section 13. In yet still a more particular aspect, the degree of curvature of the first and second ends 11, 12 ranges from about 45 degrees at the point where the first and second ends 11, 12 substantially intersect with the distal edge of the middle section 13 with the degree of curvature continuously and gradually decreasing to about 0 degrees where the first and second ends 11, 12 substantially intersect with the proximal edge of the middle section 13. In even still a more particular aspect, the degree of curvature of the first and second ends 11, 12 ranges from about 30 degrees at the point where the first and second ends 11, 12 substantially intersect with the distal edge of the middle section 13 with the degree of curvature continuously and gradually decreasing to about 0 degrees where the first and second ends 11, 12 substantially intersect with the proximal edge of the middle section 13.

In another aspect, the first and second ends 11, 12 of the platform 10 curve from the middle section 13 in a downward direction with each end 11, 12 flaring outwardly in opposing directions. In still a more particular embodiment, the first and second ends 11, 12 of the platform 10 curve from the middle section 13 in a downward direction such that the middle section 13 is substantially trapezoidal in shape.

In particular embodiments, the first and second ends 11, 12 extend the same distance from the middle section 13 (i.e., the first and second ends 11, 12 are symmetrical). In another embodiment, the first and second ends 11, 12 extend different distances from the middle section 13 (i.e., the first and second ends 11, 12 are asymmetrical). In still another embodiment, the first end 11 extends farther from the middle section 13 than the second end 12. In yet another embodiment, the second end 12 extends farther from the middle section than the first end 11. In some embodiments, either or each end may comprise a tab for engaging with the support members. In particular aspects, the tab is substantially perpendicular with a horizontal plane. In certain aspects, one or both ends can comprise a tab for engagement with the track. In embodiments, the tab is an extension of the end and adds height to that side. In embodiments where the tab is included on only one side, the height of one end is greater than the height of the other end. During use, when the tab is placed in the track (depth of track is same as the height added to the side by the tab) the middle planar section of the platform is provided level to a user.

In particular embodiments, the dimensions of the middle section 13 and the first and second ends 11, 12 respectively depends at least upon the dimensions of the support members (e.g., the arm rests 20 or armrest covers 30) and the placement of the track member 40 on the armrests 20 and armrest covers 30.

In particular aspects, the length of the first and second ends 11, 12 (i.e., the longitudinal length of the end) is about equal to the depth of the middle section 13 (i.e., the perpendicular distance between the distal edge of the middle section 13 and the proximal edge of the middle section 13).

In embodiments, the length of the first and second ends 11, 12 can range between about 6 inches and about 36 inches (e.g., 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, 25 inches, 26 inches, 27 inches, 28 inches, 29 inches, 30 inches, 31 inches, 32 inches, 33 inches, 34 inches, 35 inches, 36 inches, and so on). In a more particular aspect, the length of the first and second ends 11, 12 is in a range between about 10 inches and about 36 inches. In still a more particular aspect, the length of the first and second ends 11, 12 is in a range between about 12 inches and about 36 inches.

Further, the depth of the middle section 13 (i.e., the perpendicular distance between the distal edge of the middle section 13 and the proximal edge of the middle section 13) can range between about 6 inches and about 36 inches (e.g., 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, 25 inches, 26 inches, 27 inches, 28 inches, 29 inches, 30 inches, 31 inches, 32 inches, 33 inches, 34 inches, 35 inches, 36 inches, and so on). In a more particular aspect, the depth of the middle section 13 is in a range between about 10 inches and about 36 inches. In still a more particular aspect, the depth of the middle section is in a range between about 12 inches and about 36 inches.

The width of the middle section 13 is defined by the width of the distal and proximal edges (i.e., the distance from one end of an edge to the opposing end of that edge). In a particular aspect, the distal and proximal edges of the middle section 13 are the same width. In another aspect, the distal and proximal edges of the middle section 13 are different widths. In a more particular aspect, the distal edge of the middle section is wider than the proximal edge of the middle section 13. In still a more particular aspect, the proximal edge of the middle section 13 is wider than the distal edge of the middle section 13.

In particular aspects, the width of the distal and proximal edges of the middle section 13 can each independently range between about 6 inches and about 36 inches (e.g., 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, 25 inches, 26 inches, 27 inches, 28 inches, 29 inches, 30 inches, 31 inches, 32 inches, 33 inches, 34 inches, 35 inches, 36 inches, and so on). In a particular aspect, the width of the proximal edge of the middle section 13 is in a range between about 10 inches and about 36 inches. In another particular aspect, the width of the proximal edge of the middle section 13 is in a range between about 12 inches and about 36 inches. Likewise, the width of the distal edge of the middle section 13 is in a range between about 10 inches and about 36 inches. In another particular aspect, the width of the distal edge of the middle section 13 is in a range between about 12 inches and about 36 inches.

In other aspects, the middle section 13 may further comprise a surface treatment capable of frictionally engaging at least one object to the platform 10. The surface treatment can be any physical change to the platform 10 or the deposit of any material onto the platform 10 so long as there is an increase in the coefficient of kinetic friction between an object and the platform 10 when the platform 10 is at an angle. Non-limiting examples of materials capable of increasing friction for frictionally engaging at least one object to the platform 10 include one or more polyresinous materials. In a more particular aspect, the one or more polyresinous materials includes rubber (e.g., silicone rubber, plane rubber, etc.), latex, etc. Other surface treatments for increasing the friction are well known in the art and easily applied to the platform 10 as described herein.

In still other aspects, the middle section 13 may comprise securing components (e.g., a lip, shelf, clip, or pegs) to secure one or more personal items to the platform 10.

Support Members

The support members as described herein, may be any object capable of supporting the platform 10. In a particular aspect, the support member 20 may be independently and selectively movable. In another aspect, only one support member 20 is independently and selectively movable and the opposing support member 20 is stationary or fixed (i.e., does not move). In still another aspect, both support members 20 are stationary or fixed. In embodiments where one or both of the support members 20 are moveable, it is envisioned that one or both the support members 20 can be made stationary or fixed to an article of furniture using methods known to those skilled in the art. One or both of the support members 20 can be made permanently stationary or reversibly coupled. Non-limiting examples or methods for fixing one or more of the support members 20 as described herein to an article of furniture are known to those skilled in the art and include, but are not limited to, the use of screws, bolts, adhesives, staples, hook-and-loop attachment systems, button systems, zipper systems, etc.

In embodiments provided herein, the support members 20 may be made of any acceptable material so long as the chosen material is of sufficient strength and rigidness to withstand the rigors of its intended use. In certain embodiments, each support member 20 is made of the same material. In other embodiments, each support member 20 is made of different material. Non-limiting examples of acceptable materials for manufacture of the support members 20 include metals, alloys, plastics, polymers, woods, foams, combinations of materials comprising metals, alloys, plastics, woods, and/or foams, composite materials, etc.

In particular embodiments, the support members are manufactured from at least one plastic material. Non-limiting examples of plastics acceptable for the manufacture of the platform 10 include polyolefins, polyesters, nylons, polynylons, vinyls, polyvinyls, acrylics, polyacrylics, polycarbonates, polystyrenes, polyurethanes, as well as combinations thereof, and the like.

In a more particular embodiment, the support members 20 are manufactured from at least one metallic material. Non-limiting examples of metallic materials acceptable for the manufacture of the platform 10 include aluminum, steel, nickel copper, magnesium, titanium, iron, brass, as well as alloys and combinations thereof and the like.

Further, the support members 20 may be any conceivable shape (e.g., circular, U-shaped, oval, oblong polygonal, such as a triangular, square, pentagonal, hexagonal, or octagonal in shape etc.) so long as the support members 20 can serve their intended purpose as described herein. In particular embodiments, the support members 20 are configured to provide a planar support surface. For example, in embodiments the planar support surface of one support member 20 can be configured to provide a planar surface on which a mouse and/or mouse pad can be placed. Further, for example, the planar support surface of one support member 20 can be configured to provide a planar surface on which an end of the raised platform 10 can rest to support the raised platform 10 in a desired position.

In certain embodiments, the support members further comprise at least one track member 40 for receiving and engaging with an end of the platform 10. In particular embodiments, both support members comprise a track member 40. In a more particular embodiment, only one support member comprises a track member 40. According to embodiments disclosed herein, the track member 40 can be disposed anywhere on the support members so long as the track member 40 is able to receive and engage with at least one end of the platform 10. In particular embodiments, the track member 40 has a length equal to the length of the support members 20. In a particular aspect, the track member 40 has a length equal to the length of an end 11, 12 of the platform 10. In a more particular embodiment, the track member 40 has a length equal to twice the length of an end 11, 12 of the platform 10.

In particular embodiments, the track member 40 is a longitudinal groove disposed in or along a surface of the support member for slidable engagement with at least one end of the platform 10. In particular aspects, the track member 40 may be recessed in the support member 20 for receipt of and slidable engagement with at least one end of the platform 10. In another embodiment, the track member 40 extends outwardly from the bottom or side of the support member for slidable engagement with at least one end of the platform 10.

In still further embodiments, the support members 20 further comprise at least one auxiliary accessory, such as a cup holder 60 or an electronic accessory 50. Non-limiting examples of electronic accessories include mouse pads or a mouse.

In some embodiments, the support members are armrests 20 or armrest covers 30. In a particular aspect, the armrests 20 or armrest covers 30 may be independently and selectively movable. In another aspect, only one armrest 20 or armrest cover 30 is independently and selectively movable and the opposing armrest 20 or armrest cover 30 is stationary or fixed (i.e., does not move). In still another aspect, both of the armrests 20 or armrest covers 30 are stationary or fixed. In embodiments where one or both of the armrests 20 or armrest covers 30 are moveable, it is envisioned that one or both the armrests 20 or armrest covers 30 can be made stationary or fixed to an article of furniture using methods known to those skilled in the art as described above.

In particular aspects, the armrests 20 or armrest covers 30 may be upholstered with one or more fabric materials. In a more particular aspect, the armrests 20 or armrest covers 30 may be further filled with a material to add comfort during the upholstery process. Materials known to add comfort are known in the art and non-limiting examples include foams, cotton, Styrofoam®, etc.

In particular embodiments, the support members are armrests 20. In more particular embodiments, the armrests comprise a top wall 21, a bottom wall 22, an outer wall 23, and an inner wall 24. In more particular embodiments, the armrests further comprise at least one track member 40.

In particular embodiments, one or both of the armrests 20 may have one or more track members 40 disposed on one or more of the walls. In a particular embodiment, both armrests 20 have at least one track member 40 disposed thereon. In another particular embodiment, only one armrest 20 has at least one track member 40 disposed thereon. The track member 40 may be disposed on any part of the armrest 20.

In a particular embodiment, the track member 40 is disposed on a wall of the armrest 20.

In one aspect, the track member 40 is disposed on the top wall of the armrest 20. A non-limiting example of a track member 40 disposed on the top wall 21 could include a longitudinal groove 41 disposed along the top wall 21 of the armrest 20 for slidable engagement with an end of the platform 10.

In another embodiment, the track member 40 is disposed on the bottom wall of the armrest 20. In this embodiment, the track member 40 could extend outwardly from the bottom wall 22 for slidable engagement with at least one end of the platform In still another embodiment, the track member 40 can be disposed on the outer wall 23 or the inner wall 24. In a particular embodiment, the track member 40 is disposed on the inner wall along a longitudinal axis for receiving at least one end of the platform 10 for lateral positioning of the platform 10. In a particular embodiment, the track member 40 receives at least one end of the platform 10 in a channel 41 disposed in the track member 40.

In still other aspects, at least one of the armrests 20 further comprises at least one auxiliary accessory. In an embodiment, the auxiliary accessory is an electronic accessory. Non-limiting examples of electronic accessories include mouse pads or a mouse. In a particular aspect, at least one of the armrests 20 comprises a mouse pad 50 on the top wall 21. In another particular embodiment, the auxiliary accessory is a cup holder 60 disposed on a wall of the armrests 20.

In another embodiment, the support members are armrest covers 30. In a particular aspect, the armrest covers comprise a top surface 31, a bottom surface 32, and at least one track member 40.

In particular embodiments, one or both of the armrest covers 30 may have one or more track members 40 disposed on one or more of the surfaces. In a particular embodiment, both armrest covers 30 have at least one track member 40 disposed thereon. In another particular embodiment, only one armrest cover 30 has at least one track member disposed thereon. The track member 40 may be disposed on any part of the armrest cover 30.

In a particular embodiment, the track member 40 is disposed on a surface of the armrest covers 30.

In one aspect, the track member 40 is disposed on the top surface 31 of the armrest cover 30. In a particular embodiment, the at least one track member is a longitudinal groove 41 disposed on the top surface 31 of the armrest cover 30 for slidable engagement with at least one end of the platform 10.

In another aspect, the track member 40 is disposed on the bottom surface 32 of the armrest cover 30. In a particular aspect, the track member 40 is a track extending perpendicularly and downward from the bottom surface 32 of the armrest cover 30 for slidable engagement with at least one end of the platform.

In still another embodiment, the track member can be disposed on the side surfaces of the armrest covers 30.

In still other aspects, at least one of the armrest covers 30 further comprises at least one auxiliary accessory such as a cup holder 60 or an electronic accessory. Non-limiting examples of electronic accessories include mouse pads 50 or a mouse. In a particular aspect, at least one of the armrest covers 30 comprises a mouse pad on the top surface 31.

Track Member

The track member 40 as described herein may be any track or guide member capable of engaging with at least one end of the platform 10 to provide lateral movement of the platform 10. Track assemblies are well known in the mechanical arts and the track member 40 described herein can include any track assembly meeting the requirements of the adjustable platform 1 as described herein. In particular embodiments, the track member 40 may comprise ball bearings, terminal stops on each end of the track assembly, pawl-and-ratchet positioning mechanisms, and/or interfacing rails.

In particular embodiments, the track member 40 is a defined channel 41 in the track member or a groove 41 in at least one of the support members 20. In certain particular aspects, the depth of the channel is equal to the height of the tab added to one of the ends of the platform. For example, if the depth of the channel is 0.5 inches from the planar surface of the support member, then the platform should have one end with a height that is 0.5 inches greater than the height of the other end. During use, when the end with the greater height is inserted into the channel of the track, the overall platform can be provided to a user with the middle section of the platform provided at a level height. In embodiments provided herein, the track member 40 may be made of any acceptable material so long as the chosen material is of sufficient strength and rigidness to withstand the rigors of its intended use. Non-limiting examples of acceptable materials for manufacture of the track member 40 include metals, alloys, plastics, polymers, woods, combinations of materials comprising metals, alloys, plastics, and/or woods, composite materials, etc.

In particular embodiments, the track member 40 is manufactured from at least one plastic material. Non-limiting examples of plastics acceptable for the manufacture of the track member 40 include polyolefins, polyesters, nylons, polynylons, vinyls, polyvinyls, acrylics, polyacrylics, polycarbonates, polystyrenes, polyurethanes, as well as combinations thereof, and the like.

In a more particular embodiment, the track member 40 is manufactured from at least one metallic material. Non-limiting examples of metallic materials acceptable for the manufacture of the track member 40 include aluminum, steel, nickel copper, magnesium, titanium, iron, brass, as well as alloys and combinations thereof and the like.

In certain embodiments, the channel or groove 41 may further comprise a surface treatment capable of frictionally engaging the platform 10 when it is positioned to the user's desired location. The surface treatment to the channel or groove 41 can be any physical change to the channel or groove 41 or the deposit of any material into/onto the channel or groove 41 so long as there is an increase in the coefficient of kinetic friction between the platform 10 and the channel or groove 41 when the platform 10 is engaged in the channel or groove 41. Non-limiting examples of materials capable of increasing friction for frictionally engaging the platform 10 in the channel or groove 41 include one or more polyresinous materials. In a more particular aspect, the one or more polyresinous materials includes rubber (e.g., silicone rubber, plane rubber, etc.), latex, etc. Other surface treatments for increasing the friction are well known in the art and easily applied to the channel or groove 41 as described herein.

With reference to the appended figures, FIGS. 1-5 illustrate embodiments of the adjustable platform 1 for application to a sitting surface 100.

FIG. 1 shows an overall view of one of the embodiments of the adjustable platform 1. In particular, FIG. 1. shows an embodiment of the adjustable platform 1 as described herein. The raised platform 10, as described herein, comprises a first end 11, a second end 12, and a middle section 13 disposed between the first and second ends 11, 12 wherein a portion of each of the first and second ends 11, 12 has a degree of curvature enabling the first and second ends 11, 12 to curve and extend in a downward direction from the middle section at a point where the first and second ends communicate with the middle section 13. Further shown is that the first and second support members 20 are armrests configured for receiving opposing ends of the raised platform.

As is further illustrated in FIG. 1 one of the armrests 20 has a track member 40 disposed on an inner wall 23 along a longitudinal axis for receiving an end 11 of the platform 10 for lateral positioning of the platform 10 when that end of the platform 10 is engaged with the track member 40. A flat space is available for an auxiliary accessory such as a cup holder 60 or some other electronic accessory such as a mouse pad 50, to allow the user to use a mouse to control a laptop, which may be placed on the platform 10. When in use, at least one end of the platform 10 is in communication with the track member 40 and the opposing end of the platform 10 is in communication with the opposing armrest. The armrests 20 are in communication with the sitting surface 100, and at least one armrest 20 is independently and selectively movable.

Figure 2:
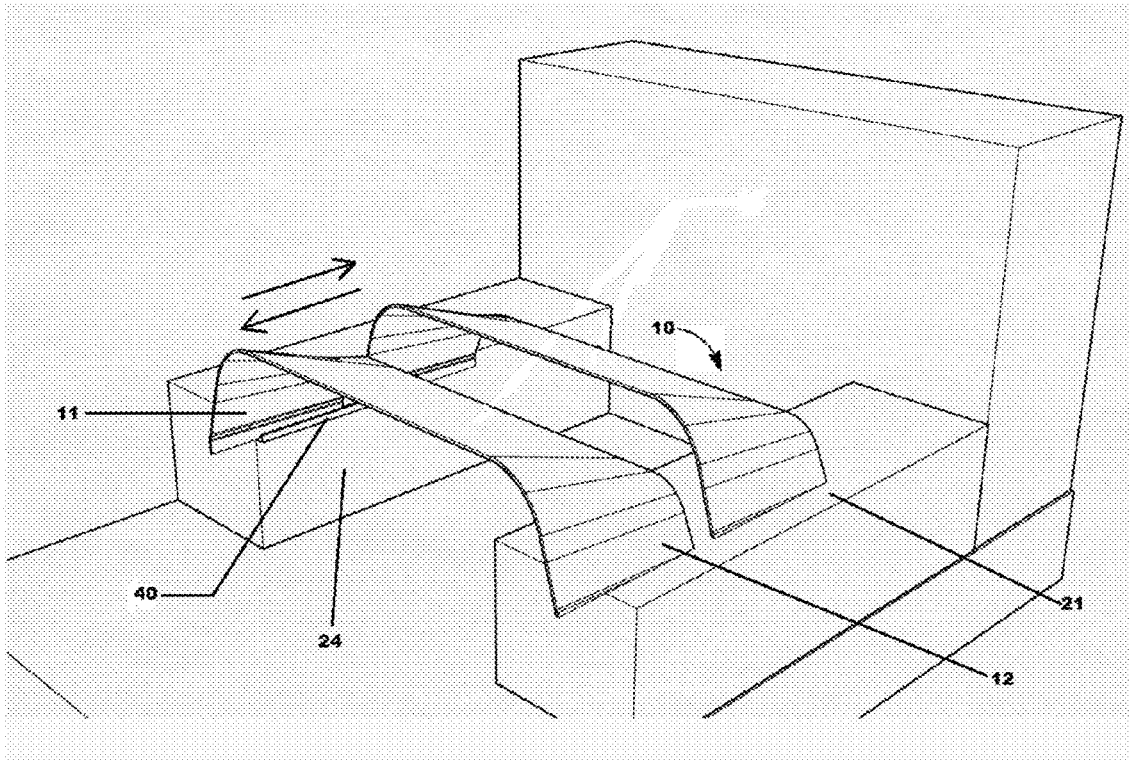
FIG. 2 is a schematic diagram showing a perspective view demonstrating the adjustability of the platform in an embodiment of the adjustable platform as described herein.

As shown in FIG. 2, platform 10 is able to move in a lateral direction along the length of the track member 40. In this embodiment, one or both of the armrests 20 may be independently and selectively movable. In particular, FIG. 2 shows how the position of the platform 10 can be adjusted relative to the user (e.g., the platform 10 can be made to be closer or farther from the user). The length of the track member 40 is longer than the depth of the platform 10. In the embodiment illustrated in FIG. 2, one end of the platform 10 can slide back and forth on the track member 40 and the opposing end remains on the top of the opposing armrest 20. The mouse pad 50 remains independent and usable for the user in this embodiment.

Figure 3:
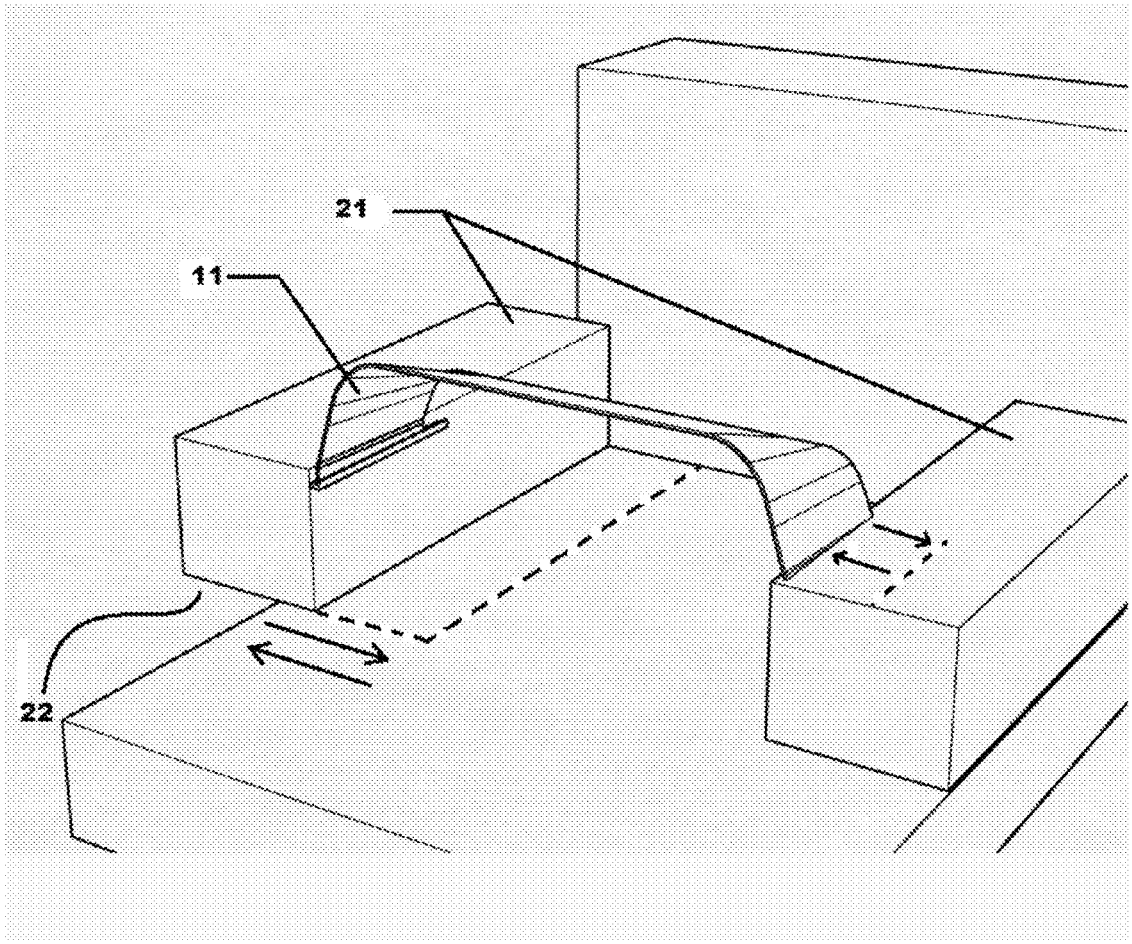
FIG. 3 is a schematic diagram showing a perspective view demonstrating the adjustability of the armrests in an embodiment of the adjustable platform as described herein.

FIG. 3 shows how one armrest 20 moves in a left to right direction to adjust the inner space between two armrests 20, to better fit users of different body sizes. Platform 10 moves with both the armrests 20. As long as an end of the platform 10 remains on the top wall 21 of the other armrest 20, the user's item will be sufficiently supported. In embodiments where one of the armrests is fixed, the maximum adjustment range is equal to the width of the fixed armrest. In this embodiment, however, one or both of the armrests 20 may be independently and selectively movable.

Figure 4:
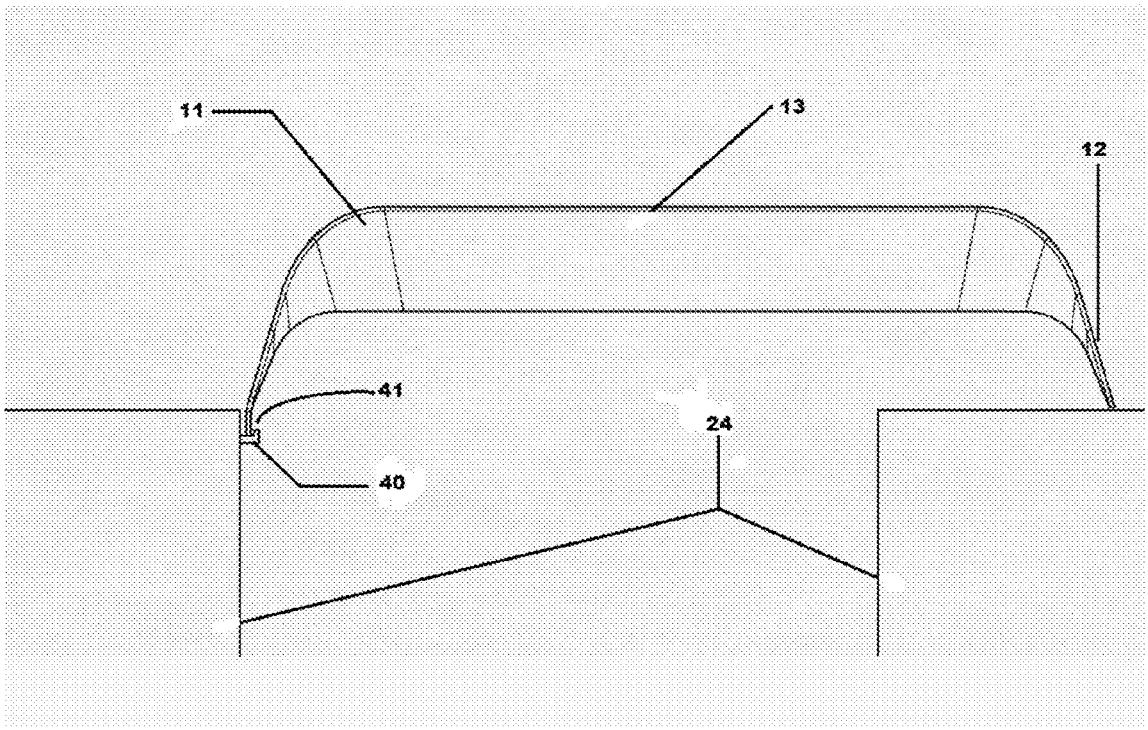
FIG. 4 is a schematic diagram showing a perspective view demonstrating the communication between the platform and the armrests in an embodiment of the adjustable platform as described herein.

FIG. 4 illustrates how platform 10 is mounted on the track member 40 of the armrest 20. In this embodiment, the track member 40 (i.e., the slide track) is a simple notch on the side of the movable armrest 20. The length of the track member 40 is longer than the longitudinal length of the ends 11, 12 of the platform 10 allowing the platform 10 to be adjusted to a customizable distance from the user and accommodating the user's arm length. The other end of the platform is simply placed on the fixed armrest 20. In this embodiment, however, one or both of the armrests 20 may be independently and selectively movable.

Figure 5:
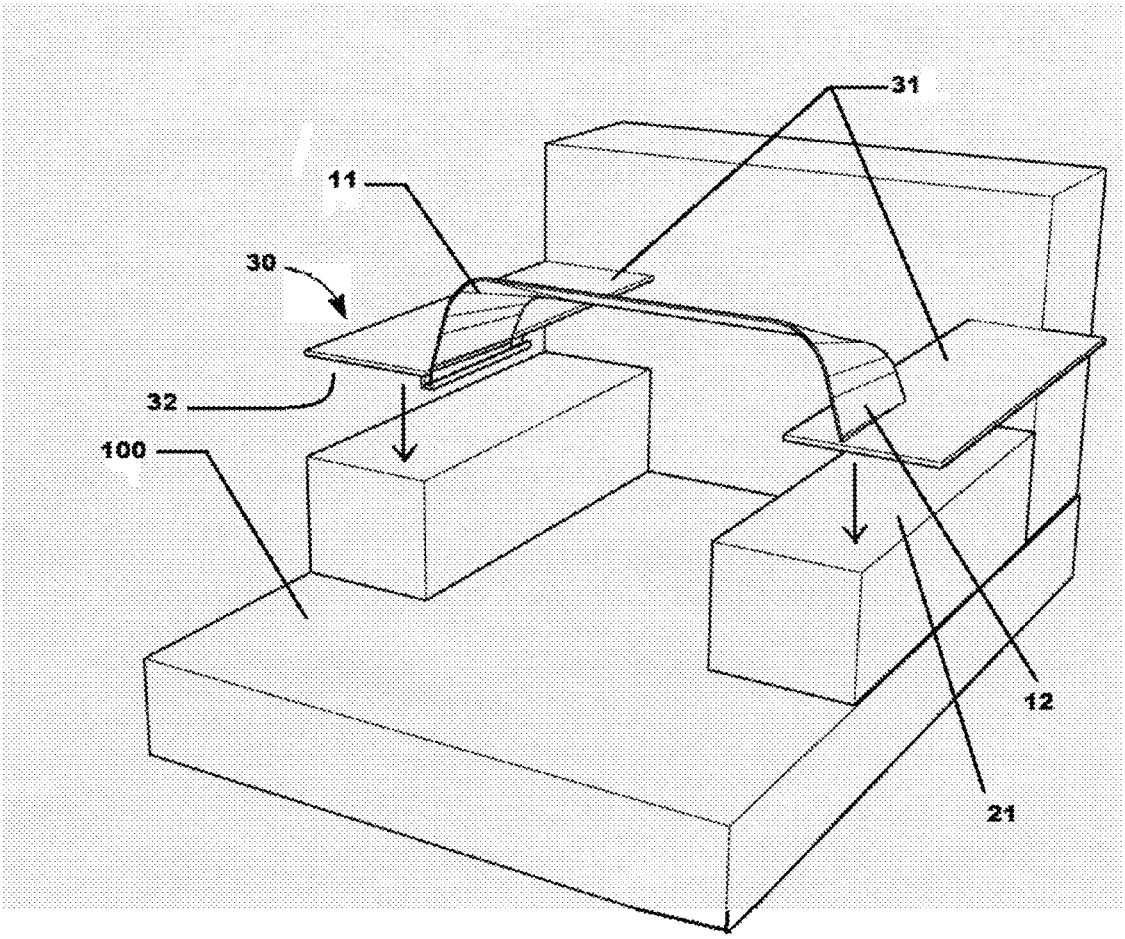
FIG. 5 is a schematic diagram showing a perspective view of an alternative embodiment of the adjustable platform as described herein when applied to furniture having existing armrests.
Figure 6:
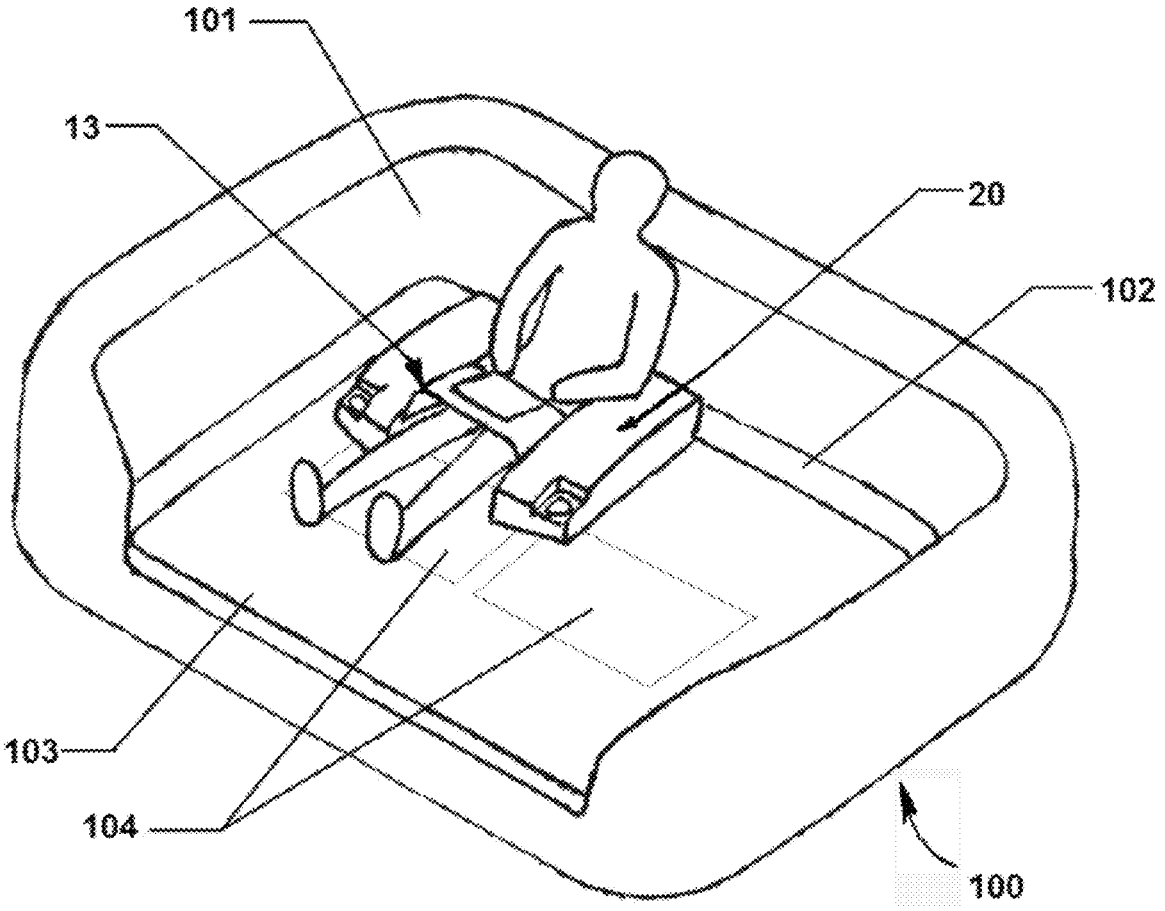
FIG. 6 is a schematic diagram showing a perspective view of an alternative embodiment of the adjustable platform as described herein when applied to large articles of furniture such as, for example, a couch or sofa.

FIG. 5 illustrates an alternative embodiment wherein the support members are armrest covers 30. In this embodiment, two armrest covers 30 are applied to the armrests of a normal lounge chair 100. Similar to the embodiments described in FIGS. 1-4, the platform 10 can be adjusted (i.e., maneuvered) in four directions. The adjustable platform 1 for application to furniture armrests comprises a platform 10 as described herein.

The alternative embodiment illustrated in FIG. 5 shows a pair of armrests covers 30, wherein each armrest cover has a top surface 31, a bottom surface 32, and at least one track member 42 disposed on the top or bottom surface 31, 32 for receiving at least one end (either the first end 11 or the second end 12) of the platform 10 for lateral positioning of the platform 10 when at least one end of the platform is engaged with the track member 40. At least one end of the platform 10 is in communication with the track member 40, the armrest covers 30 are in communication with the furniture armrests, and at least one armrest cover 30 is independently and selectively movable.

FIGS. 6-9 show yet another alternative embodiment of the adjustable platform provided herein. In this embodiment, the adjustable platform 1 is applied to a large piece of furniture, such as a couch or sofa 100 as shown. In this embodiment, the armrests 20 can be positioned against any of the three sides of the backrest 102. Such provides versatility for the user to choose different sitting configurations to satisfy different needs. Further, the armrests 20 may also include an auxiliary accessory such as a cup holder 60.

Figure 7:
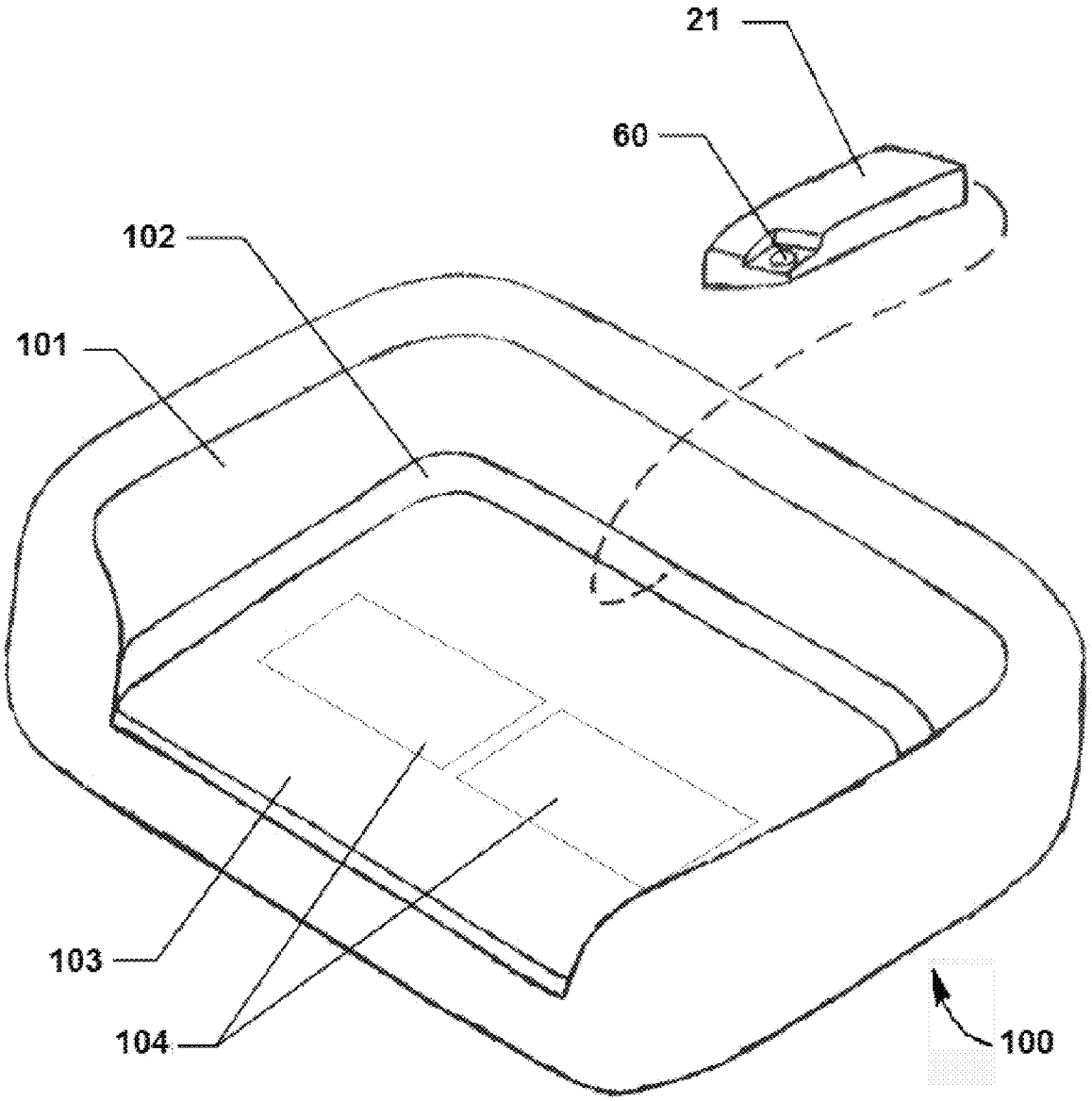
FIG. 7 is a schematic diagram showing a perspective view of an embodiment of how the support members of the adjustable platform may be adapted to be coupled to an article of furniture.
Figure 8:
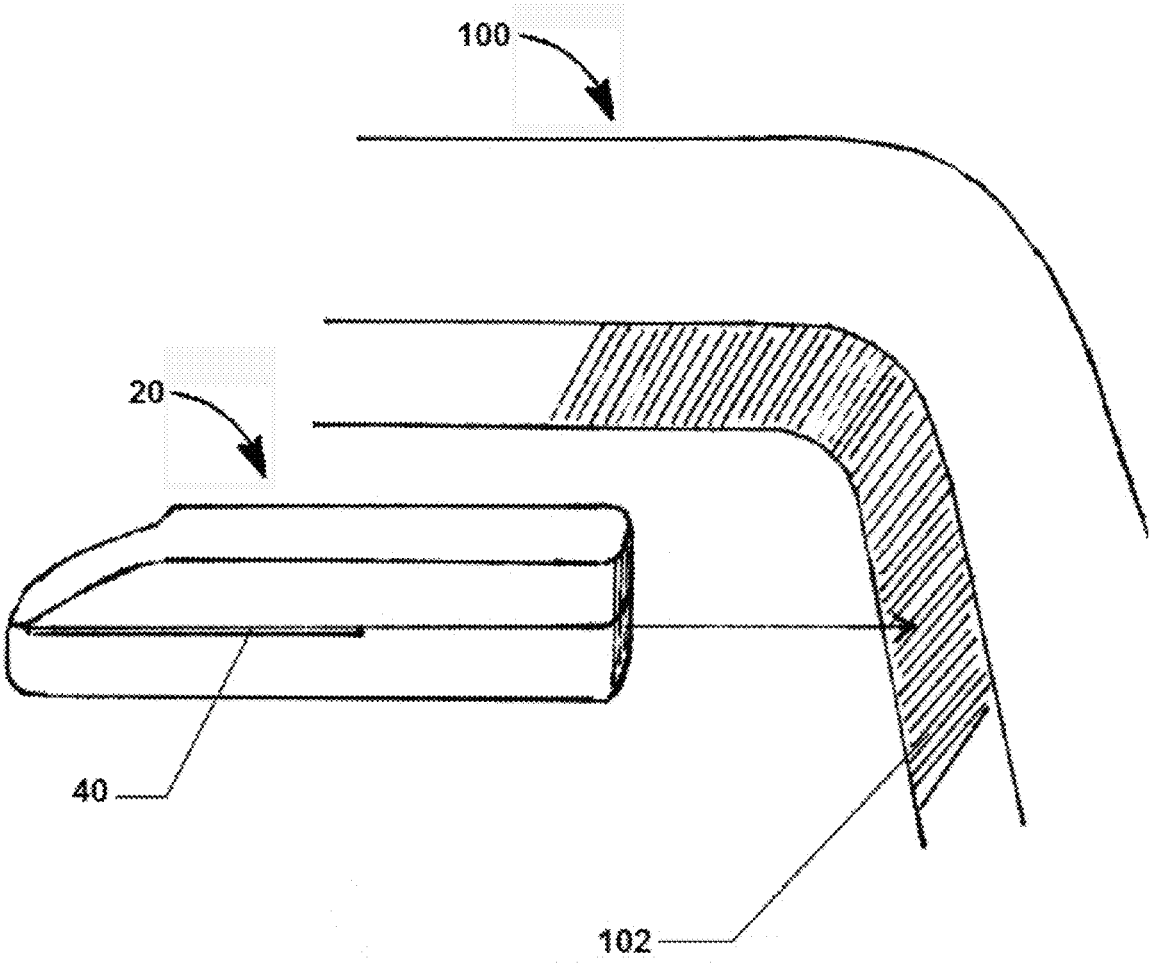
FIG. 8 is a schematic diagram showing a partial cut-away view of an embodiment of how the support members of the adjustable platform may be adapted to be coupled to an article of furniture.

As shown in FIG. 7, the backs of each armrest 20 are abutted against the backrest 102. Once positioned against the backrest 102, each arm rest can be made to be fixed or adjustable. Each armrest 20 can be fixed to the backrest 102 using commonly known attachment systems in the art. As shown in FIG. 8, the armrest 20 can be fixed to the backrest 102 using a hook and loop system (e.g. Velcro( ) integrated into the adjustable platform 1 and the article of furniture 100. In particular, the rear surface of the armrest 20 attaches to the surface of the backrest 102. In other aspects, the rear and bottom of each armrest 20, as well as the back rest 102 and cushions of the furniture, can include an attachment system (e.g., a hook and loop attachment system) to allow custom adjustment and temporary fixation of the adjustable platform 1.

Figure 9:
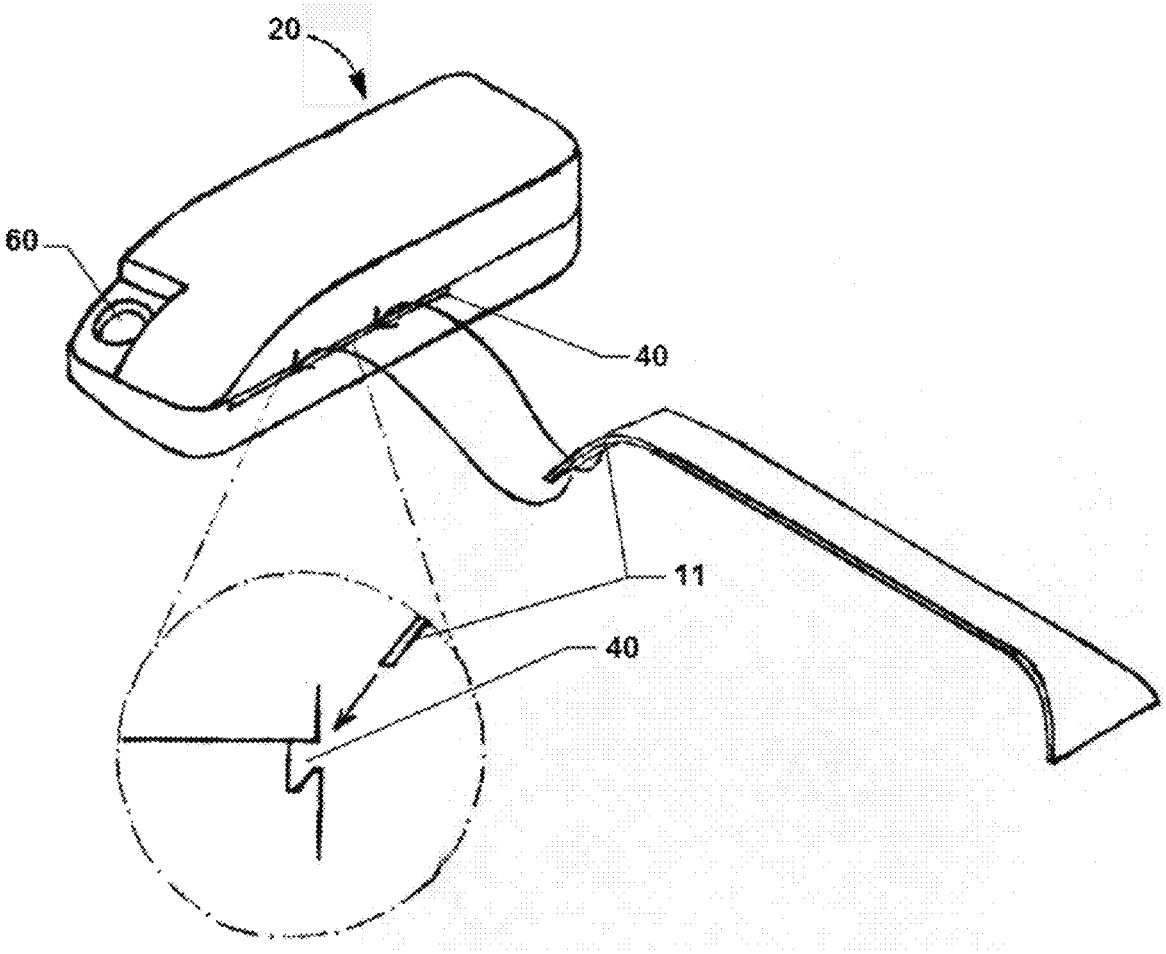
FIG. 9 is a schematic diagram showing an embodiment of how the platform is mounted to a support member.

FIG. 9 shows another embodiment for engaging an end of the platform 10, into the arm rest 20. In the embodiment provided, the track member 40 is a groove recessed into the arm rest 20. When an end of the platform 10 is placed into the track 40, the platform 10 can be positioned along the track member 40 at a distance that is comfortable for the user.

Figure 10:
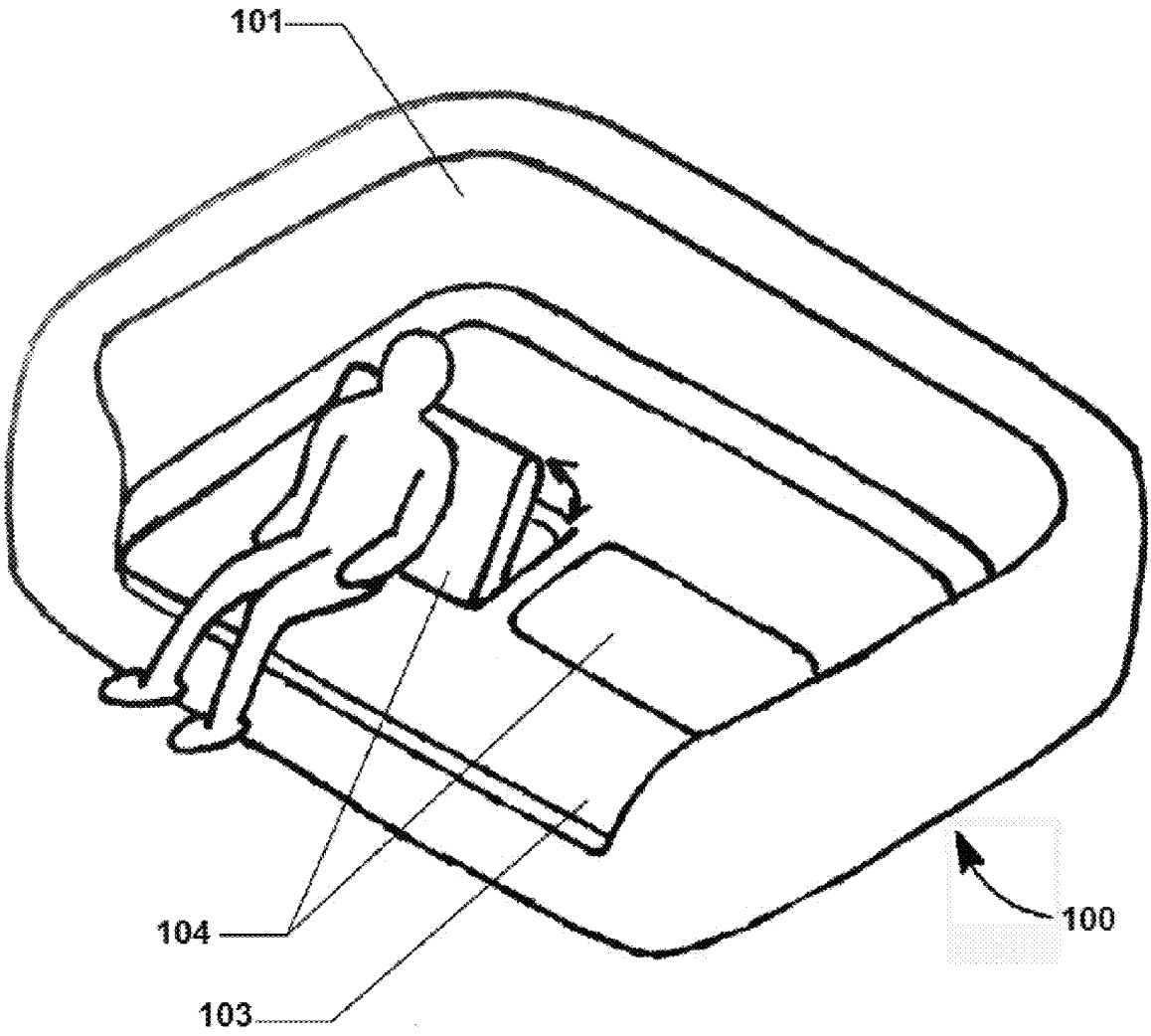
FIG. 10 is a schematic diagram showing alternate configurations of the backrest shown in FIGS. 6-9.

FIG. 10. shows the article of furniture provided in FIGS. 6-9. In particular, the article of furniture has foldable backrests 104. When the foldable backrest 104 is retracted (i.e., configured in a horizontal position), foldable backrest 104 functions as part of the cushion 103. When the foldable backrest is configured in an upright position, foldable backrest 104 functions as a normal backrest. This also flexibility for multiple users to have back support. For example, one user may choose to use back rest 101, and another may choose to use foldable backrest 104.

Articles of Furniture

Further disclosed is an article of furniture 200 having an adjustable platform 1. The article of furniture 200 comprises and adjustable platform 1 comprising first and second armrests 20 and a raised platform 10 for supporting an object. The raised platform 10 comprises a first end 11, a second end 12, and a planar middle section 13 disposed between the first and second ends 11, 12, with a portion of each of the first and second ends 11, 12 having a degree of curvature enabling the first and second ends 11, 12 to curve and extend in a downward direction from the middle section at a point where the first and second ends 11, 12 communicate with the middle section 13. The first and second armrests 20 are configured for receiving the first or second ends 11, 12 of the raised platform 10.

In particular embodiments, both armrests 20 are independently and selectively movable. In another particular embodiment, only one armrest 20 is stationary or fixed (i.e., does not move) and the opposing armrest 20 is independently and selectively movable.

In a particular aspect, the middle section 13 slopes in a downward direction from a distal edge of the middle section to a proximal edge of the middle section 13. In particular embodiments, the middle section 13 slopes in a downward direction from a distal edge of the middle section 13 to a proximal edge of the middle section 13 at angle between about 0 degrees and about 90 degrees. In a more particular embodiment, the middle section 13 slopes in a downward direction from a distal edge of the middle section 13 to a proximal edge of the middle section 13 at angle between about 5 degrees and about 45 degrees.

In particular embodiments, the platform 10 may be permanently fixed within the track member 40 or removable. In one aspect the platform 10 is slidably engaged within the track member 40 but permanently fixed within the track. In another aspect, the platform 10 is removable from the track member 40 (e.g., the platform 10 can be removed from the track member 40 and engaged with the track member 40 as desired by the user).

In a particular aspect, when only one armrest 20 is fixed and the opposing armrest 20 is independently and selectively movable, the track member 40 is disposed on the armrest that is movable. In another particular aspect, when only one armrest 20 is fixed and the opposing armrest 20 is independently and selectively movable, the track member 40 is disposed on the armrest that is fixed.

The article of furniture may be any article of furniture. Non-limiting examples include chairs, benches, couches, sectional couches, sofas, loveseats, futons, recliners, beds, etc.

With reference to the appended figures, FIGS. 11-15 illustrate embodiments of articles of furniture comprising an adjustable platform 1 as described herein.

Figure 11:
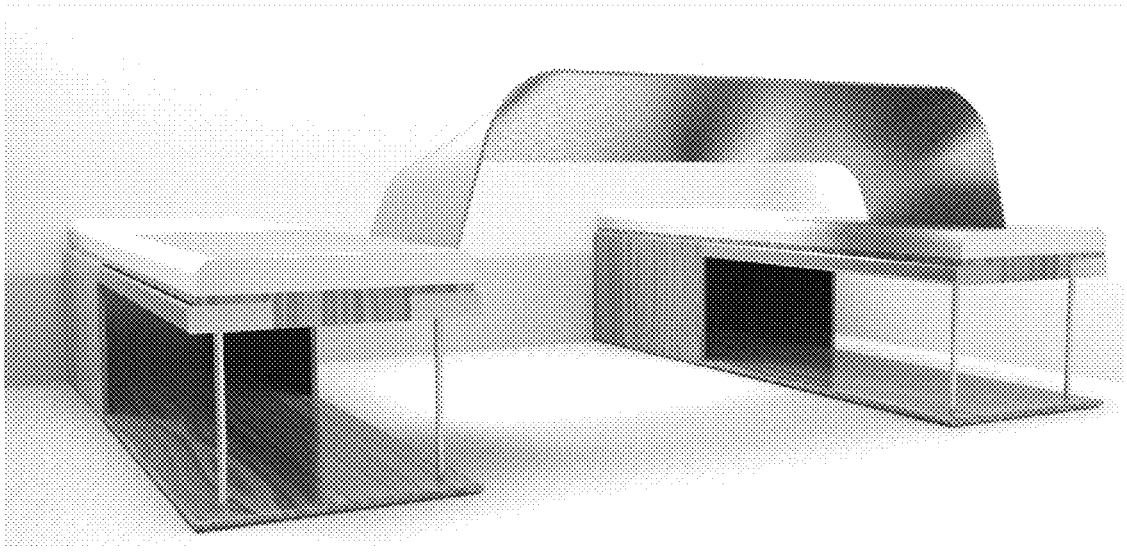
FIG. 11 is a schematic diagram showing a perspective view of an embodiment of the adjustable platform as described herein.
Figure 12:
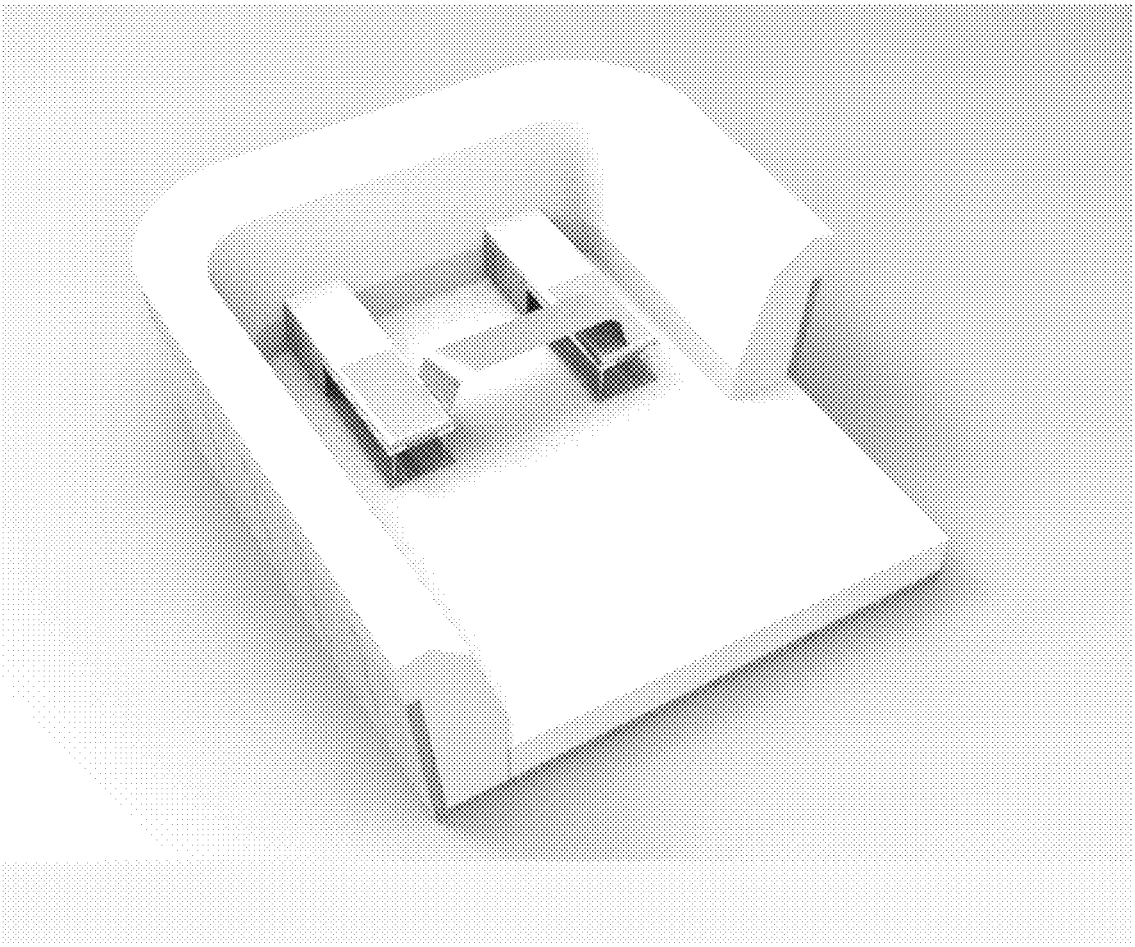
FIG. 12 is a schematic diagram showing a perspective view of an embodiment of the adjustable platform as described herein applied to an article of existing furniture.

Turning to FIGS. 11 and 12, the embodiment illustrated shows a pair of armrests having storage capability while incorporating the adjustable platform 10 as described herein. In an embodiment, both armrests 20 are independently and selectively movable. In another embodiment, only one of the armrests 20 are independently and selectively movable and the opposing armrest is stationary or fixed (i.e., does not move). In a more particular embodiment, the armrest comprising the groove 40 is independently and selectively movable and the opposing armrest is stationary or fixed. FIG. 12 illustrates the use of the embodiment shown in FIG. 11 as applied to an article of furniture 100, in particular, a couch.

Figure 13:
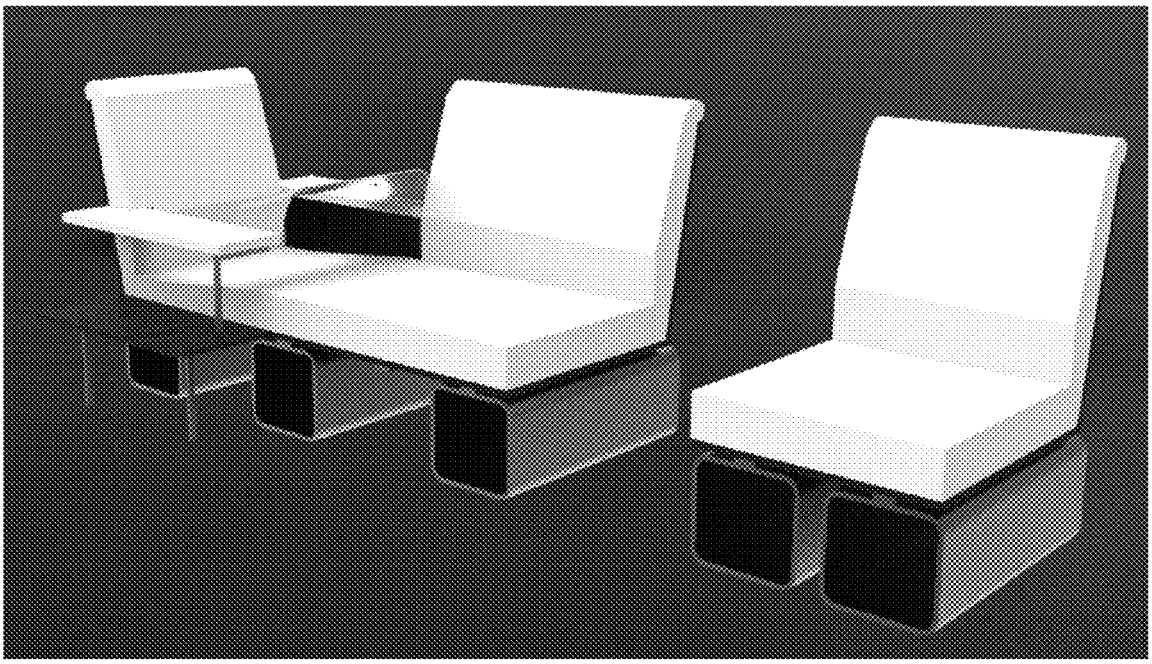
FIGS. 13-14 are schematic diagrams showing a perspective view of an article of furniture comprising an adjustable platform as described herein.
Figure 14:
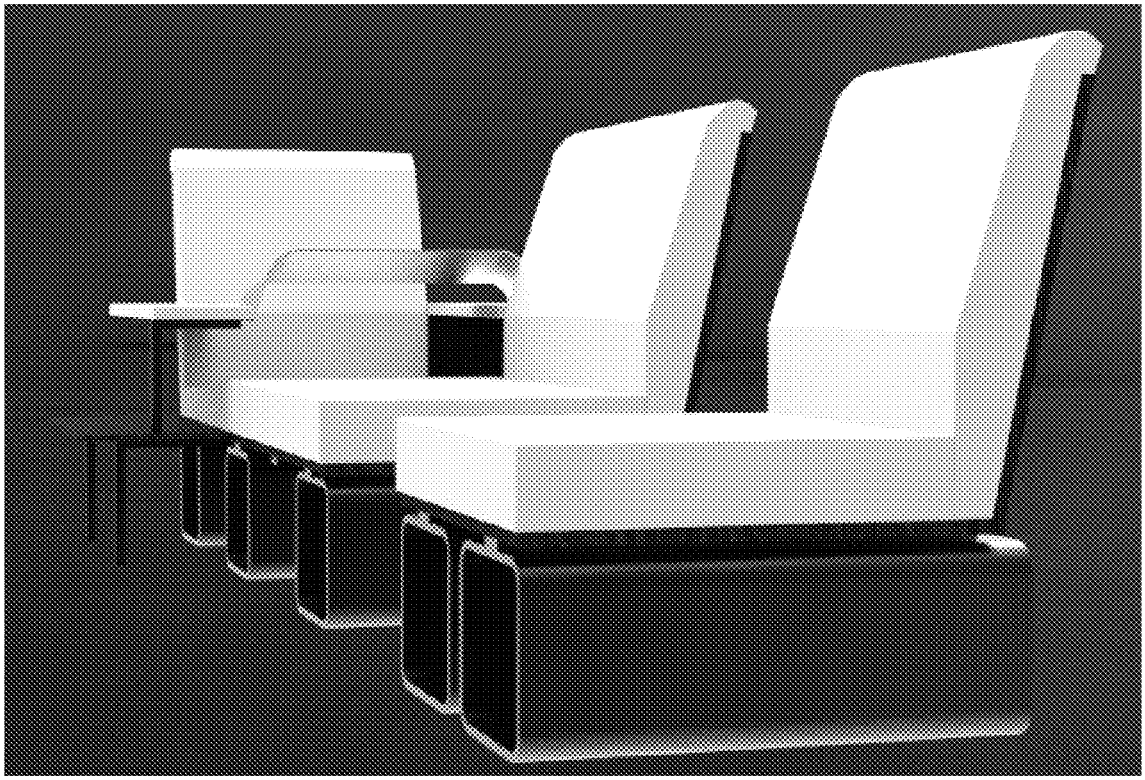

FIGS. 13-14 illustrate two perspectives of another article of furniture comprising the adjustable platform as described herein, in particular a sofa comprising an adjustable platform 10. In an embodiment, both armrests 20 are independently and selectively movable. In another embodiment, only one of the armrests are independently and selectively movable and the opposing armrest is stationary or fixed. In a more particular embodiment, the armrest comprising the groove is independently and selectively movable and the opposing armrest is stationary or fixed.

Figure 15:
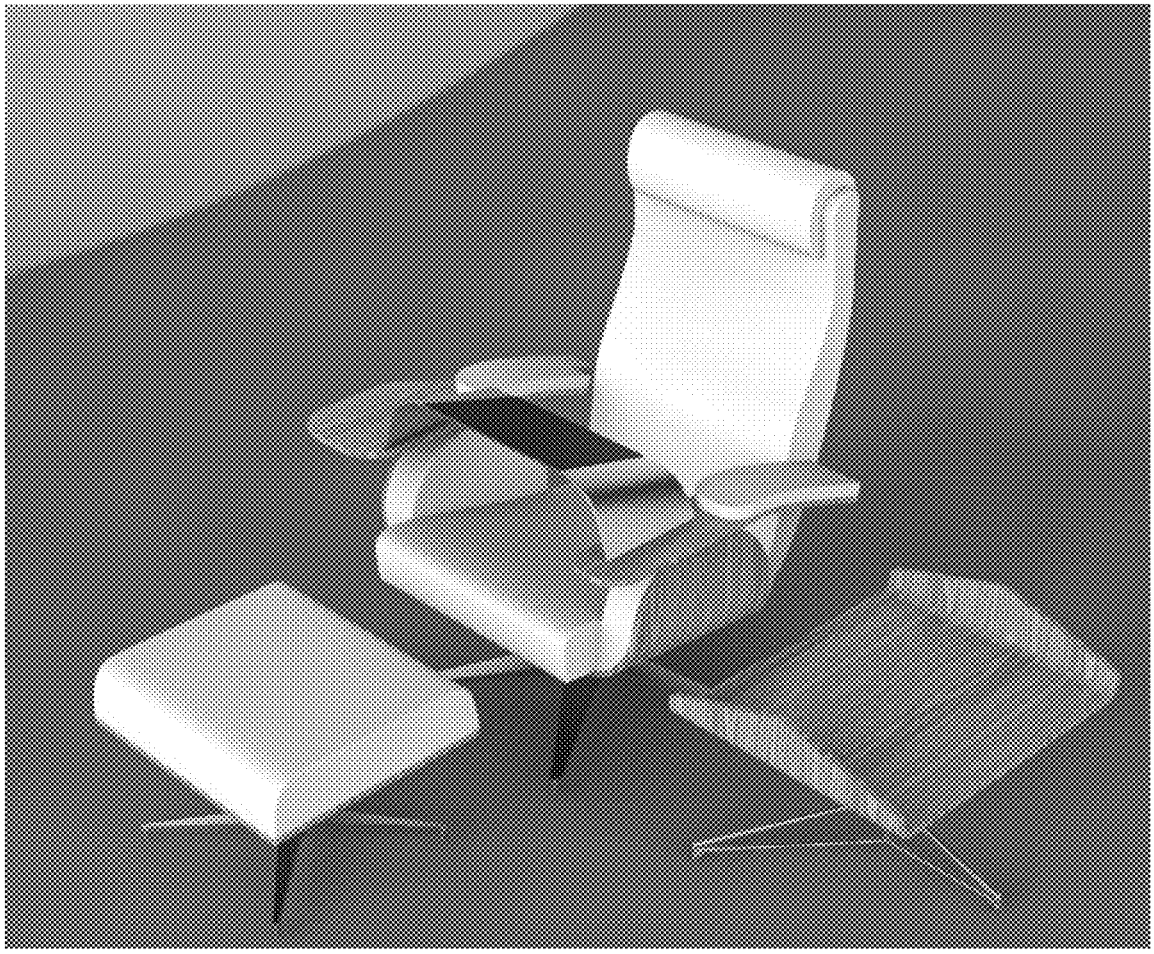
FIG. 15 is a schematic diagram showing a perspective view of another article of furniture comprising an adjustable platform as described herein.

FIG. 15 illustrates yet another article of furniture 100 comprising the adjustable platform as described herein, in particular, a chair comprising the adjustable platform. In an embodiment, both armrests are independently and selectively movable. In another embodiment, only one of the armrests are independently and selectively movable and the opposing armrest is stationary or fixed (i.e., does not move). In a more particular embodiment, the armrest comprising the groove is independently and selectively movable and the opposing armrest is stationary or fixed.

Kits

Further described herein is a ready to assemble adjustable platform kit. The adjustable platform kit comprises a first package comprising a platform 10 as described herein, and a second package comprising a pair of support members 20 and at least one track member 40 as described herein. In particular embodiments, the pair of support members 20 are armrests. In another embodiment, the pair of support members are armrest covers 30.

In particular aspects, the one or more track members 40 may be packaged separately with materials for installation onto one or more of the support members 20. In other aspects, the one or more track members 40 may be preinstalled onto the one or more of the support members 20.

In other particular embodiments, the kit may further comprise an additional package comprising materials for adapting and/or installing (e.g., either permanent or temporary installation) the adjustable platform 1 as described herein onto an existing article of furniture.

The present disclosure has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. An adjustable workstation platform comprising:

a first support member;

a second support member; and a raised platform for supporting an object, the raised platform comprising a first end, a second end, and a planar middle section disposed between the first and second ends and between a distal edge and a proximal edge;

wherein a portion of each of the first and second ends has a degree of curvature enabling the first and second ends to curve and extend in a downward direction from the middle section respectively to a first bottom edge of the raised platform and a second bottom edge of the raised platform;

wherein the distance from the first bottom edge to the second bottom edge along the distal edge is greater than the distance from the first bottom edge to the second bottom edge along the proximal edge;

wherein a top surface of the middle section of the raised platform lies in a plane at an angle relative to a plane in which the top surface of the first support member lies;

wherein, when the raised platform is disposed on the first and second support members, a maximum perpendicular height of the middle section measured from the distal edge to the plane in which the top surface of the first support member lies is greater than a maximum perpendicular height of the middle section measured from the proximal edge to the plane in which the top surface of the first support member lies; and wherein the first and second support members are configured for receiving the first or second ends of the raised platform.

2. The adjustable workstation platform of claim 1, wherein the middle section slopes in a downward direction from the distal edge of the middle section to the proximal edge of the middle section.

3. The adjustable platform of claim 2, wherein the middle section slopes in a downward direction from a distal edge of the middle section to a proximal edge of the middle section at angle between about 0 degrees and about 90 degrees.

4. The adjustable workstation platform of claim 1, wherein at least one of the first and second support members is independently and selectively movable.

5. The adjustable workstation platform of claim 1, wherein only one of the first and second support members is independently and selectively movable.

6. The adjustable workstation platform of claim 1, wherein at least one of the first and second support members further comprises a track member for receiving the first or second end of the platform.

7. The adjustable workstation of claim 1, wherein both the first and second support members comprise a track member for receiving the first or second ends of the platform.

8. The adjustable workstation of claim 1, wherein only one of the first and second support members comprises a track member for receiving the first or second end of the platform.

9. The adjustable workstation platform of claim 1, wherein the first end of the platform extends in a downward direction from the middle section farther than the second end of the platform, such that the first end has a height greater than the second end.

10. The adjustable workstation platform of claim 9, wherein the first support member comprises a track member for receiving the first end of the platform and the second support member is configured for receiving the second end of the platform.

11. The adjustable workstation platform of claim 10, wherein only the first support member is independently and selectively movable.

12. The adjustable workstation platform of claim 10, wherein the first support member further comprises a mouse pad.

13. The adjustable workstation platform of claim 1, wherein the first and second support members are armrests.

14. The adjustable workstation platform of claim 1, wherein the first and second support members are armrest covers.

15. The adjustable platform of claim 3, wherein the middle section slopes in a downward direction from a distal edge of the middle section to a proximal edge of the middle section at angle between about 5 degrees and about 45 degrees.

16. An article of furniture comprising:

a first armrest;

a second armrest; and a raised platform for supporting an object, the raised platform comprising a first end, a second end, and a planar middle section disposed between the first and second ends and between a distal edge and a proximal edge;

wherein a portion of each of the first and second ends has a degree of curvature enabling the first and second ends to curve and extend in a downward direction from the middle section respectively to a first bottom edge of the raised platform and a second bottom edge of the raised platform;

wherein the distance from the first bottom edge to the second bottom edge along the distal edge is greater than the distance from the first bottom edge to the second bottom edge along the proximal edge;

wherein a top surface of the middle section of the raised platform lies in a plane at an angle relative to a plane in which the top surface of the first armrest lies;

wherein, when the raised platform is disposed on the first and second armrests, a maximum perpendicular height of the middle section measured from the distal edge to the plane in which the top surface of the first armrest lies is greater than a maximum perpendicular height of the middle section measured from the proximal edge to the plane in which the top surface of the first armrest lies; and wherein the first and second armrests are configured for receiving the first or second ends of the raised platform.

17. The article of furniture of claim 16, wherein, at least one of the first and second armrests is independently and selectively movable.

18. The article of furniture of claim 16, wherein, at least one of the first and second armrests further comprises a track member for receiving the first or second end of the platform.

19. The article of furniture of claim 16, wherein, the first armrest comprises the track member.

20. The article of furniture of claim 19, wherein the first armrest is independently and selectively movable.

* * * * *